United States Patent [19]

Claffey et al.

[11] Patent Number: 4,656,097

[45] Date of Patent: Apr. 7, 1987

[54] POST TREATMENT OF PHOSPHATED METAL SURFACES BY ORGANIC TITANATES

[76] Inventors: William J. Claffey, 15174 Hook Hollow Rd., Novelty, Ohio 44072; Alan J. Reid, 13345 County Line Rd., Gates Mills, Ohio 44040

[21] Appl. No.: 766,917

[22] Filed: Aug. 19, 1985

[51] Int. Cl.[4] ..... B32B 15/04

[52] U.S. Cl. ..... 428/457; 148/6.15 R; 148/6.15 Z; 427/327; 427/409; 427/417; 427/418; 427/419.8; 428/469; 428/470

[58] Field of Search ..... 427/409, 417, 418, 419.8, 427/327; 148/6.15 R, 6.15 Z, 6.16; 428/469, 470, 457

[56] References Cited

U.S. PATENT DOCUMENTS

| | | | |
|---|---|---|---|
| 3,002,854 | 10/1961 | Brill | 427/419.8 |
| 3,458,364 | 7/1969 | Upham | 148/6.16 |
| 3,776,782 | 12/1973 | Kiefer et al. | 148/6.16 |
| 3,895,970 | 7/1975 | Blum et al. | 148/6.16 |
| 3,912,548 | 10/1975 | Faigen | 148/6.16 |
| 4,143,205 | 3/1979 | Rowe et al. | 148/6.16 |
| 4,165,242 | 8/1979 | Kelly et al. | 427/417 |
| 4,281,037 | 7/1981 | Choung | 427/418 |
| 4,495,156 | 1/1985 | Rohowetz | 427/419.8 |

*Primary Examiner*—Sadie L. Childs

[57] ABSTRACT

A method of treating phosphated metal surfaces to improve the corrosion-inhibiting properties of the metal surfaces and to improve the adhesion of siccative organic coatings thereto is described. The method comprises treating a phosphated metal surface with an aqueous solution of a water-soluble organic titanium chelate which forms a water-insoluble deposit on the phosphated metal surface. Preferably, the water-soluble organic titanium chelate compound is TYZOR CLA, TYZOR 131 OR TYZOR 101. Optionally, though not required, the titanium chelate treated phosphated metal surfaces can be rinsed with water prior to the application of a siccative organic coating. In lieu of, or in addition to, the siccative organic coating, the titanium chelate treated, phosphated metal surfaces can be given a seal coating of a rust-inhibiting oil. Metal surfaces and metal articles treated in accordance with the method of the present invention also are described.

19 Claims, No Drawings

POST TREATMENT OF PHOSPHATED METAL SURFACES BY ORGANIC TITANATES

BACKGROUND OF THE INVENTION

This invention relates to an improved metal treatment process, and more particularly, to a new and improved method of treating phosphated metal surfaces to provide more durable and rust-inhibiting coatings. The invention relates particularly to the post treatment of phosphated metal surfaces with an aqueous solution of a water-soluble organic titanium chelate which forms a water-insoluble deposit on the phosphated metal surface.

It is well known in the metal finishing art that metal surfaces such as aluminum, ferrous, galvanized ferrous and zinc surfaces may be coated with an inorganic phosphate by contacting them with an aqueous phosphating solution. The phosphate coating protects the metal surface to a limited extent against corrosion and serves primarily as an excellent base for the later application of corrosion-inhibiting compositions and siccative organic coating compositions such as paint, lacquer, varnish, primers, synthetic resins, enamel, and the like.

The inorganic phosphate coatings generally are formed on a metal surface by means of aqueous solutions which contain phosphate ion and, optionally, certain auxiliary ions including metallic ions such as sodium, manganese, zinc, cadmium, copper, lead, calcium-zinc and antimony ions. These aqueous solutions also may contain non-metallic ions such as ammonium, chloride, bromide, fluoride, nitrate, sulfate, and borate ions. These auxiliary ions influence the reaction with the metal surface, modify the character of the phosphate coating, and adapt it for a wide variety of applications. Other auxiliary agents such as oxidizing agents, coloring agents, and metal cleaning agents also may be incorporated in the phosphating solution.

As mentioned above, inorganic phosphate coatings provide an excellent base for the application of siccative organic coatings such as paints or lacquers. The provision of such phosphate coatings has been found to improve both the adhesion of the paint or lacquer film to the metal surface and the corrosion resistance of the painted metal.

Solvent-base siccative organic coating compositions have been applied to metal surfaces such as by spraying, dipping, rolling centrifuged dip-spinning, etc. Water-soluble resin base paints and lacquers can be applied by electrophoresis. The electrophoretic application of paint and lacquer involves the phenomena of electro-osmosis and electrolysis, as well as electrophoresis. In this method, an electric current is passed through the paint or lacquer solution while the article to be painted is made an electrode, usually the anode, in the paint or lacquer.

Although the adhesion of the siccative organic coating to the metal surface is improved by the phosphate coating, it has been noted, for example, where ferrous metal, galvanized ferrous metal or phosphated ferrous metal parts are provided with a siccative top coat of lacquer or enamel and such top coat is scratched or scored during, for example, handling, forming or assembling operations, the metal substrate becomes a focal point for corrosion and for a phenomenon known as "undercutting". Undercutting, or the loosening of the top-coat in areas adjacent to a scratch or score causes a progressive flaking of the top-coat from the affected area. In severe cases, the undercutting may extend an inch or more from each side of the scratch or score, causing a loosening and subsequent flaking of the top-coat from a substantial portion, if not all, of the metal article. The undercutting also results in a reduction of the desirable corrosion-resistance properties.

It has been suggested in the prior art that the problem of undercutting can be minimized, and the corrosion-proofing properties of siccative coated metal surfaces improved by treating the phosphated metal surface with various chromium-containing acidic solutions prior to the application of the siccative coating. Aqueous solutions containing hexavalent or trivalent chromium compounds, or mixtures of hexavalent and trivalent chromium compounds have been suggested as useful chromium treatments. The chromic acid rinse solutions appear to "seal" the phosphate coating and improve its utility as a base for the application of siccative organic coatings. However, the use of chromium solutions does result in environmental and health problems created by the toxic chromium compounds. Hexavalent chromium compounds are known to be lethal, and the discharge of trivalent chromium compounds as green waste materials is objectionable.

Chromium free treatment of phosphate coatings has been suggested in U.S. Pat. Nos. 4,110,129; 4,182,637; 4,264,378 and 4,362,577. U.S. Pat. No. 4,110,129 describes the use of an aqueous solution containing a water soluble titanium compound such as titanium fluoride, titanium sodium fluoride or potassium titanyl oxalate and at least one adjuvant compound such as phosphoric acid, phytic acid, or tannin and hydrogen peroxide. U.S. Pat. No. 4,182,637 describes a rinse containing the combination of citric acid and sodium nitrite to enhance corrosion protection. U.S. Pat. No. 4,362,577 describes an aqueous acidic rinse containing hypophosphorous acid, salts of hypophosphorous acid or sodium hypophosphate. U.S. Pat. No. 4,264,378 describes a rinse containing phosphate, a metal cation, and molybdate, vanadate, niobate or tantalate ions. The inventions described in these four patents have a common shortcoming. They do not form insoluble complexes with phosphate and are therefore not suitable for use with electrodeposited paint. It is essential not to carry soluble salts into the paint bath because they throw the electrodeposition process out of balance. Therefore a rinse with deionized water is essential before painting. It follows that the sealing rinse must form an insoluble complex with phosphate, and not be removed by a water rinse, if it is to be compatible with electrodeposited paint.

Organic titanates have often been used to bind together two different materials. U.S. Pat. No. 2,751,314 describes the use of organic titanates to bind silicone polymers to solid surfaces. U.S. Pat. No. 2,838,418 describes how the adhesion of paint to glass is improved if the glass is treated with tetralkyl titanate before painting. U.S. Pat. No. 2,948,641 describes how the adhesion of printing ink to polyethylene is increased when an organic titanate is incorporated into the polymer. Many similar applications may be found in the literature of manufacturers of organic titanates.

SUMMARY OF THE INVENTION

A method of treating phosphated metal surfaces to improve the corrosion-inhibiting properties and the adhesion of siccative organic coatings thereto is described which comprises treating a phosphated metal survace with an aqueous solution of a water-soluble organic titanium chelate which forms a water-insoluble deposit on the phosphated metal surface. Preferably, the water-soluble organic titanium chelate compound is TYZOR CLA, TYZOR 131 or TYZOR 101. The titanium chelate treated surface can be coated with a siccative organic coating, a corrosion-inhibiting film of oil, or both. Optionally, though not required, the titanium chelate treated phosphated metal surfaces can be rinsed with water prior to the application of a siccative organic coating. Metal surfaces and metal articles treated in accordance with the methods of the present invention also are described.

DESCRIPTION OF THE PREFERRED EMBODIMENTS

The method of this invention can be utilized to improve the adhesion of siccative organic coatings to metal surfaces and to improve the corrosion-inhibiting properties of metal surfaces such as aluminum, iron, steel, galvanized and zinc surfaces.

The invention is particularly applicable to such surfaces having an inorganic phosphate coating thereon. The preparation and use of aqueous phosphating solutions for depositing inorganic phosphate coatings on metal surfaces is well known in the metal finishing art as shown by U.S. Pat. Nos. 1,206,075; 1,485,025; 2,001,754; 2,859,145; 3,090,709; 3,104,177; 3,307,979, 3,364,081 and 3,458,364. The disclosures of these patents regarding inorganic phosphating solutions and the procedures for using such solutions are hereby incorporated by reference. The inorganic phosphate coatings may be any of those known in the art including zinc phosphate coatings, iron phosphate coatings, lead phosphate coatings, cadmium phosphate coatings, and mixed calcium-zinc phosphate coatings. The iron phosphate coatings can be applied over iron, steel or alloys thereof, and the zinc phosphate coatings generally are applied over iron, steel, zinc, aluminum, or alloys thereof.

In view of the extensive commercial development of the phosphating art and the many journal publications and patents describing the preparation and application of phosphating solutions, it is believed unnecessary to lengthen this specification unduly by a detailed recitation of the many ways in which the application of metal phosphate coatings can be accomplished. It should be sufficient to indicate that any of the commonly used phosphating techniques such as spraying, brushing, dipping, roller-coating, or flow-coating may be employed, and that the temperature of the aqueous phosphating solution may vary within wide limits such as, for example, from room temperature to about 100° C. Generally, best results are obtained when the aqueous phosphating solution is used at a temperature within the range of from about 65° to about 100° C. If desired, however, the phosphating baths may be used at higher temperatures when employing super atmospheric pressures.

In the ordinary practice of phosphating a metal surface, the surface generally is cleaned initially by physical and/or chemical means to remove any grease, dirt, or oxides, and then it is phosphated in the manner described above. Cleaning solutions are known in the art and generally are aqueous solutions containing sodium hydroxide, sodium carbonate, an alkali metal silicate, alkali metal metaborate, water softeners, phosphates, and surface active agents. Oxide removal is usually accomplished with mineral acid pickles such as sulfuric acid, hydrochloric acid, and phosphoric acid. This removal could be considered as supplemental cleaning.

The phosphating operation usually is carried out until the desired weight of the phosphate coating is formed on the metallic surface. The time required to form the coating will vary according to the temperature, the type of phosphating solution employed, the particular technique of applying the phosphating solution, and the coating weight desired. In most instances, however, the time required to produce the phosphate coating of the weight preferred for the purpose of the first step of the present invention will be within the range of from about 1 second to as long as 15 to 40 minutes depending on the type of phosphating solution. When high total acid aqueous phosphating solutions are used, the immersion time is from about a few seconds to one to two minutes.

After the desired contact between the surfaces to be treated and the phosphate solution has been effected for the desired period of time, the phosphated article preferably is rinsed, optionally, with water to remove any of the acidic coating solution which may remain on the surface. Preferably, a hot water rinse is used with water temperatures within a range of from about 50° to about 100° C. As with the application of the phosphate coating solution, various contacting techniques may be used, with rinsing by dipping or spraying being preferred.

In accordance with the method of the present invention, the phosphated article is treated with an aqueous solution of a water-soluble organic titanium chelate which forms a water-insoluble deposit on the phosphated metal surface. Generally, the aqueous solution of the water-soluble organic titanium chelates will contain from about 0.005 to about 5% by volume of the titanium chelate and more generally from about 0.01 to about 2% by volume of the titanium chelate. When the more dilute solutions of the titanium chelates are used in the method of the invention, it is not necessary to rinse the treated surface with water prior to drying and/or painting. As with the application of the phosphate coating solution, the aqueous solutions of the titanium chelates can be applied by various techniques such as spraying, brushing, dipping, roller-coating or flow-coating. The temperature of the titanium chelate solution may be varied over wide limits and is not critical. Acceptable results are obtained at about ambient temperature.

In a preferred method of the present invention, the water-soluble organic titanium chelates useful in the present invention are proprietary chemicals available from the DuPont Company, Chemicals and Pigments Department, Wilmington, Del. 19808 under the DuPont designations TYZOR® CLA, TYZOR 131 and TYZOR 101. Because these chemicals are proprietary chemicals of DuPont, the precise chemical nature of the titanium chelates is not publicly known.

The organic titanate TYZOR CLA and its properties are described in the DuPont brochure entitled "Polyfunctional TYZOR® Organic Titanates For Crosslinking Catalysis and Surface Modification", 32 pages, identification No. E-60136 10/83 (3M). TYZOR CLA is therein identified as a proprietary chemical (77% in isopropanol) and containing 8.6% titanium. The specific gravity (25° C./25° C.) is reported to be 1.03.

TYZOR 131 which is available from DuPont is a clear yellow liquid having a specific gravity at 25° C. of 1.266 and ±0.015, a boiling point of 100° C. and a freezing point of less than −25° C. TYZOR 131 is reported as being soluble in water, isopropyl alcohol and methyl alcohol. TYZOR 131 is reported to contain 3.54%±0.09 of titanium.

TYZOR 101 also is a clear yellow liquid having a specific gravity at 25° C. of 1.310±0.015. The boiling point at 760 mm. is 100° C. and the freezing point is less than −25° C. TYZOR 101 contains 3.15%±0.09% of titanium, and typical solvents for TYZOR 101 are water, isopropyl alcohol and methyl alcohol.

The time of contact between the phosphated metal surface and the solution of water-soluble organic titanium chelate in accordance with the method of the invention is not critical and may be varied over a wide range. The time of contact can be as little as five or ten seconds to as much as ten minutes or more. In most instances, a contact time of from about ten seconds up to about one or two minutes is sufficient.

After the metal surface has been treated with the water-soluble titanium chelate, it is dried. Drying can be effected by allowing it to drain and dry at ambient temperature, by subjecting the treated surface to a current of hot air, by passing the treated surface through a heated zone, etc.

Optionally the titanium chelate treated phosphated metal surface is rinsed with water prior to any application of a siccative organic coating. The water rinse removes impurities and any water-soluble titanium chelates from the surface whose presence may interfere with the application of the organic coating.

The treated and dried metal surface may then be provided with a siccative organic top-coat such as a top-coat of paint, enamel, varnish, lacquer, synthetic resin, primer, etc., to provide further protection and/or decorative effects. Such top-coats may be applied by conventional means such as by spraying, brushing, dipping, roller coating, or electrophoresis. After application of the top-coat, the treated metal surface is dried either by exposure to air or by means of a baking technique, depending on the nature of the siccative top-coat material.

The siccative organic coating compositions may be organic solvent based compositions. The organic solvents generally employed in the protective coating industry include benzene, toluene, xylene, mesitylene, ethylene dichloride, trichloroethylene, diisopropyl ether, aromatic petroleum spirits, turpentine, dipentene, amyl acetate, methyl isobutyl ketone, etc.

The siccative organic coating composition may also be a water base or emulsion paint such as synthetic latex paints derived from acrylic resins, polyvinyl alcohol resins, alkyd resins, melamine resins, epoxy resins, phenolic resins, etc., by emulsification thereof with water, as well as water-soluble paints derived from water-soluble alkyd resins, acrylic resins, and the like.

The organic coating compositions may also contain conventional improving agents such as pigment extenders, anti-skinning agents, driers, gloss agents, color stabilizers, etc.

The siccative organic coating composition may be applied to the titanium chelate treated phosphated metal surface by techniques well known in the art for applying siccative organic coatings such as paints. For example, the coating may be applied by dipping, brushing, spraying, roller-coating, flow-coating, and by the electrophoretic process of painting metal surfaces. Often, the electrophoretic process is preferred because of the improved results which are obtained.

In the electrophoretic process, the metal article to be coated is placed in an electrolytic solution which contains water-emulsified colloidal paint particles. The titanium chelate treated phosphated metal surface to be painted may be either the anode or the cathode depending on the characteristics of the paint which is used. The electrophoretic application of the siccative organic coating may be carried out in various ways as are known to those skilled in the art.

The metallic pigments which may be included in the siccative organic coating compositions may be aluminum, stainless steel, bronze, copper, nickel or zinc powder pigments, and these may be either leafing or non-leafing type. The pigments may be used in the form of fine flakes or foils. Preferably the metallic pigments are such as to deposit a film on the metal articles having a bright metallic appearance. Accordingly, aluminum metal pigments are preferred.

The amount of metallic pigment included in the coating composition can be varied depending on the desired end result with respect to brightness and corrosion resistance. Generally the resin to pigment weight ratio will vary between about 2.5/1 to 4.5/1 and more preferably from about 3.25/1 to 3.75/1.

The corrosion-inhibiting properties of the titanium chelate treated phosphated metal surfaces can be further improved by applying a seal coating of a rust-inhibiting oil over the titanium chelate treated phosphate or over the siccative organic coatings described above. Although the metal parts which have been phosphated, treated with the titanium chelate, and coated with a siccative organic coating in the manner described above exhibit improved resistance to corrosion, it has been found that the inhibition of corrosion of the metal parts can be increased further by applying a seal coating of a rust inhibiting oil over the organic coating.

This seal coating, which can be applied in lieu of or in addition to the siccative organic coating, can be a straight undiluted oil such as any oil which is liquid or soluble in a solvent under the conditions of application. Examples of such oils include kerosene, fuel oil, gas oil, synthetic oils such as dioctyl adipate and dinonyl sebacate and naturally occuring oils such as castor oil, olive oil, sesame seed oil or mineral oils. Mineral oils are preferred because of their low cost and availability. Generally the oils will be fluid oils ranging in viscosity from about 40 Saybolt Universal seconds at 38° C. to about 200 Saybolt seconds at about 100° C.

The oils may be mixed with organic solvents including those used in the paint and lacquer industries, such as xylene, mesitylene, benzene, aromatic petroleum spirits, lauryl alcohol, dianyl naphthalene, dicapryl diphenyl oxide, didodecyl benzene, methyl isobutyl ketone and chloronated alkanes such as ethylene dichloride and 1,2-dichloropropene. Mixtures of these solvents are useful. On drying the seal coating, the more volatile solvents evaporate and leave a seal coating of oil as a rust-inhibiting film.

The oil seal coating can be applied as an emulsified water:oil mixture containing wetting or surface active agents followed by drying to remove the water. One advantage of the water:oil mixtures is that no hazardous organic solvents are involved in the process.

The oil which is applied as the top seal coat also may contain other compositions which improve the rust-inhibiting properties of the oil. Compositions which are known in the art may be included in the oil to be applied as the seal coat, generally in amounts up to about 2–25% or higher. One example of a preferred type of additive composition is metal-containing phosphate complexes such as can be prepared by the reaction of (a) a polyvalent metal salt of the acid phosphate esters derived from the reaction of phosphorus pentoxide with a mixture of monohydric alcohol and from about 0.25 to 4.0 equivalents of a polyhydric alcohol, with (b) at least about 0.1 equivalent of an organic epoxide. Thin films of these complexes in oil over the phosphated and painted metal parts are effective in inhibiting the corrosion of the metal surfaces.

These types of metal-containing phosphate complexes which are contemplated as being useful in the process of the invention are described in U.S. Pat. No. 3,215,715 and the disclosure of the patent is hereby incorporated by reference.

In general, the acid phosphate esters required for the preparation of starting material (a) are obtained by the reaction of phosphorus pentoxide with a mixture of a monohydric alcohol and a polyhydric alcohol. The precise nature of the reaction is not entirely clear, but it is known that a mixture of phosphate esters is formed.

The monohydric alcohols useful in the preparation of starting materials (a) are principally the non-benzenoid alcohols, that is, the aliphatic and cycloaliphatic alcohols, although in some instances aromatic and/or heterocyclic substituents may be present. Suitable monohydric alcohols include propyl, isopropyl, butyl, amyl, hexyl, cyclohexyl, methylcyclohexyl, octyl, tridecyl, benzyl and oleyl alcohols. Mixtures of such alcohols also can be used if desired. Substituents such as chloro, bromo, nitro, nitroso, ester, ether, keto, etc. which do not prevent the desired reaction also may be present in the alcohol. In most instances, however, the monohydric alcohol will be an unsubstituted alkanol.

The polyhydric alcohols useful in the preparation of starting materials (a) are principally glycols, i.e., dihydric alcohols, although trihydric, tetrahydric and higher polyhydric alcohols may be used. In some instances, they may contain aromatic and/or heterocyclic substituents as well as other substituents such as chloro, bromo, nitro, ether, ester, keto, etc. Examples of suitable polyhydric alcohols include ethylene glycol, diethylene glycol, triethylene glycol, propylene glycol, 1,3-butanediol, glycerol, glycerol monooleate, mono-benzylether of glycerol, pentaerythritol and sorbitol dioctanoate. Mixtures of these polyhydric alcohols can be used.

The reaction between the alcohol mixture and the phosphorus pentoxide is exothermic and can be carried out conveniently at a temperature ranging from room temperature or below to a temperature just below the decomposition point of the mixture. Generally temperatures within a range of from about 40° to about 200° C. are satisfactory. The reaction time varies according to the temperature and to the reactivity of the alcohols. At higher temperatures as little as 5 or 10 minutes may be sufficient for complete reaction, while at room temperature, 12 or more hours may be required.

The reaction may be conducted in the presence of an inert solvent to facilitate mixing and handling. Typical solvents include petroleum aromatic spirits boiling in the range of 120°–200° C., benzene, xylene, toluene, and ethylene dichloride. In most instances, the solvent is allowed to remain in the acid phosphate esters and ultimately in the final metal-containing organic phosphate complex which serves as a vehicle for the convenient application of films to the painted articles.

The conversion of the acid phosphate esters to the polyvalent metal salt can be carried out by any of the usual methods for preparing salts of organic acids. The polyvalent metal of starting material (a) may be any light or heavy polyvalent metal such as zinc, cadmium, lead, iron, cobalt, nickel, barium, calcium, strontium, magnesium, copper, bismuth, tin, chromium, or manganese. The polyvalent metals of Group II of the periodic table generally are preferred. One example of a highly effective starting material (a) is the zinc salt of the acid phosphate esters formed by the reaction of a mixture of equivalent amounts of isooctyl alcohol and dipropylene glycol with phosphorus pentoxide.

As mentioned above, the complex is obtained by reacting the polyvalent metal salts (a) with (b) an organic epoxide. Organic epoxides suitable for the purpose of this invention include the various substituted and unsubstituted alkylene oxides containing at least two aliphatic carbon atoms, such as, e.g., ethylene oxide, 1,2-propylene oxide, 1,3-propylene oxide, 1,2-butylene oxide, pentamethylene oxide, hexamethylene oxide, 1,2-octylene oxide, cyclohexene oxide, styrene oxide, alpha-methyl styrene oxide, beta-propiolactone, methyl epoxycaprylate, ethyl epoxypalmitate, and epoxidized soyabean oil. Of the various available organic epoxides, it is preferred to use those which contain at least 12 carbon atoms. Especially preferred are those epoxides which contain at least 12 carbon atoms and also a carboxylic ester group in the molecule. Thus, the commercially available epoxidized carboxylic ester, butyl epoxystearate, is very satisfactory as starting material (b) for the purpose of this invention. If desired, the organic epoxide may also contain substituents such as chloro, bromo, fluoro, nitro, nitroso, ether, sulfide and keto, in the molecule.

Complexes prepared using as little as 0.1 or 0.25 equivalent or as much as 1.5 or 2 or more equivalents of the organic epoxide per equivalent of polyvalent metal salt are satisfactory for the purpose of this invention. For reasons of economy and optimum corrosion inhibition, however, it is generally preferred to use about equivalent amounts of the two starting materials.

The reaction between the organic epoxide and the polyvalent metal salt of the acid phosphate esters is only slightly exothermic, so in order to insure complete reaction some heat generally is supplied to the reaction mass. The time and temperature for this reaction are not particularly critical; satisfactory results may be obtained by maintaining the mass for 0.5–6 hours at a temperature within the range of from about 40° C. to about 150° C. Ordinarily the product is clear and does not require filtration. In some instances, however, it may be desirable to filter the product, particularly when the polyvalent metal salt starting material has not been purified.

The following examples illustrate some of the types of metal-containing organic phosphate complexes which can be incorporated into the seal coat in accordance with the procedures described above.

EXAMPLE A

Dipropylene glycol (49 parts, 0.73 equivalent), 95 parts (0.73 equivalent) of isooctyl alcohol, and 133 parts of aromatic petroleum spirits boiling in the range 316°–349° F. are introduced into a reaction vessel. The whole is stirred at room temperature and 60 parts (0.42 mole) of phosphorus pentoxide is introduced portionwise over a period of about 0.5 hour. The heat of reaction causes the temperature to rise to about 80° C. After all of the phosphorus pentoxide has been added, the whole is stirred for an additional 0.5 hour at 93° C. The resulting acid phosphate esters show an acid number of 91 with bromphenol blue as an indicator.

The mixture of acid phosphate esters is converted to the corresponding zinc salt by reacting it with 34.5 parts of zinc oxide for 2.5 hours at 93° C. Thereafter 356 parts (one equivalent per equivalent of zinc salt) of butyl epoxystearate is added to the zinc salt at 88° C. over a period of about one hour and the whole is stirred for 4 hours at 90° C. Filtration of the mass yields 684 parts of a zinc-containing organic phosphate complex having the following analysis: Percent phosphorus: 3.55 Percent zinc: 3.78 Specific gravity: 1.009

EXAMPLE B

A zinc-containing organic phosphate complex is made in the manner set forth in Example A except for the following differences: 58 parts of 1,2-propylene oxide is used in lieu of the butyl epoxystearate and the reaction between the zinc salt of the acid phosphate esters and the 1,2-propylene oxide is carried out at 30°-35° C. rather than 88°-90° C.

Examples of oils and oil:water emulsions containing a metal containing organic phosphate complex of the type described above are as follows:

EXAMPLE C

An oil mixture is prepared containing 60 parts of mineral oil, 2 parts of triethanolamine, 3 parts of oleic acid, 15 parts of a sodium sulfonate wetting agent and 20 parts of the product of Example A.

EXAMPLE D

The mixture of this example comprises 65 parts of mineral oil, 2 parts of triethanolamine, 3 parts of oleic acid, 15 parts of the product of Example B and 15 parts of a sodium sulfonate wetting agent.

EXAMPLE E

An emulsion is prepared by vigorously mixing 20 parts of the oil of Example C with 80 parts of water.

The following examples are presented to illustrate specific embodiments of the method of the present invention and to illustrate the desirable results obtained. These examples are intended for purposes of illustration only and are not to be construed as limiting the scope of the invention, except as the latter is defined by the appended claims. Unless otherwise indicated in the following examples and elsewhere in the specification and claims, all parts, percentages and ratios are by weight, and all temperatures are in degrees centigrade.

EXAMPLE 1

Steel panels (10 cm×10 cm) are cleaned for one minute with a commercial alkaline cleaner used at 3% by volume and at about 49° C. The metal panels are then rinsed for 30 seconds in tap water at ambient temperature and dried with warm air.

The panels are phosphated with an iron phosphate solution prepared from commercially available iron phosphate concentrate (Man-Gill 52107) at a concentration of 4% by volume. The panels are immersed in the phosphating solution at a temperature of about 55° C. for one minute. The solution has a negative free acid of 2. The phosphated panels then are rinsed with water at ambient temperature for 30 seconds.

The thus prepared phosphated and rinsed panels are then treated with deionized water, or a commercially available trivalent chromium rinse (Irco Rinse 52810 available from Man-Gill Chemical Company, Cleveland, Ohio) or 1% v aqueous solutions of one of three water-soluble titanium chelates identified below by immersion in the liquid for about 30 seconds at ambient temperature. Following such treatment with the chrome rinse or titanium chelate, the panels are subjected to a 15-second rinse in de-ionized water and dried.

In order to demonstrate the improved properties obtained by treating the panels with the titanium chelates in accordance with the method of the present invention, all of the above panels were painted with a typical commercial white alkyd paint and cured at about 177° C.

These prepared panels (as well as the panels in the following examples) are subjected to a standard Salt Spray Corrosion Test. The test procedure and the apparatus used for this test are described in ASTM procedure B-117. In this test the treated and painted panels are scribed twice to form an X on the panel, each scribe being about 6 to 7 cm. The scribed panels are subjected to the salt spray test. The test utilizes a chamber in which a mist of spray of 5% aqueous sodium chloride is maintained in contact with the test panels for a given period of time at about 35° C. Upon removal of the panels from the test chamber, the panels are dried and the scribe is taped with masking tape which is pulled off at an angle of about 45°. Adhesion loss is recorded as the average number of 1/16 inch increments of loss of paint from each side of the scribe.

The results of the 100 hour salt spray test conducted on the panels of this example are summarized in the following Table I.

TABLE I

| Treatment | Adhesion Loss |
|---|---|
| Trivalent chromium | 0 |
| TYZOR CLA | 0 |
| TYZOR 131 | 0 |
| TYZOR 101 | 0–1 |
| Water | 4–6 |

EXAMPLE 2

The procedure of Example 1 is repeated on steel panels except that the iron phosphate coating is replaced by a zinc phosphate coating. The zinc phosphate coating is deposited as follows. Steel panels are cleaned and rinsed as in Example 1 and thereafter given a second 30-second rinse in an ambient water suspension of a titanium phosphate conditioner (Man-Gill 51219) at 0.25 oz/gal. The cleaned and rinsed panels are then treated with a commercially available zinc phosphate solution prepared from Man-Gill 51355 applied at 2% by volume at a temperature of about 55° C. The commercially available zinc phosphating solution was modified by the addition of 0.05% of a sodium nitrite activator. The phosphated panels are rinsed with water as in Example 1 and thereafter treated with a titanium chelate, or a trivalent chromium rinse, or deionized water followed by painting as described in Example 1.

The painted and dried panels are subjected to the salt spray test as described in Example 1 except that the duration of the test in this Example is 240 hours. The results of the salt spray test are summarized in the following Table II.

TABLE II

| Treatment | Adhesion Loss |
|---|---|
| Trivalent chromium | 0 |
| TYZOR CLA | 0–1 |
| TYZOR 101 | 0–1 |
| TYZOR 131 | 0–1 |
| Water | 3–5 |

EXAMPLE 3

The treatment of the panels in this Example is identical to the treatment in Example 2 with the exception that the panels are galvanized steel panels and the temperature of the zinc phosphate bath is about 60° C. The results of an 80-hour salt spray test are summarized in the following Table III.

TABLE III

| Treatment | Adhesion Loss |
|---|---|
| Trivalent chromium | 0 |
| TYZOR CLA | 0 |
| TYZOR 131 | 0 |
| TYZOR 101 | 0–1 |
| Water | 3 |

EXAMPLE 4

The general procedure of Example 1 is repeated except that the iron phosphate solution is replaced by a calcium-zinc phosphate solution prepared by adding 2.5% by volume of commercially available Man-Gill 51504 to 1.25% by volume of Man-Gill Zinc Phosphate 51339. The free acid of this bath is 1.0, and the bath is applied to steel at about 78° C. for one minute. The painted panels prepared in this Example are subjected to a 390-hour salt spray test, and the results are summarized in the following Table IV.

TABLE IV

| Treatment | Adhesion Loss |
|---|---|
| Trivalent chromium | 0–1 |
| TYZOR CLA | 0–2 |
| TYZOR 131 | 0–2 |
| TYZOR 101 | 1–3 |
| Water | 4–6 |

In the following Examples 5–8, the procedures of Examples 1–4 generally are repeated with the following exceptions: the titanium chelates are used at 0.25 pt. by volume per 100 gals. of water; the trivalent chromium rinse is replaced by a hexavalent chromium rinse available commercially under the general trade designation Man-Gill 52807; the hexavalent chromium rinse is used at 0.25 pt. by volume per 100 gals. of water; and there is no rinse with deionized water after treatment with hexavalent chromium or the titanium chelate solutions.

EXAMPLE 5

The panels utilized in this Example are prepared in accordance with the procedure of Example 1 modified as described above. The results of a 100-hour salt spray test are summarized in the following Table V.

TABLE V

| Treatment | Adhesion Loss |
|---|---|
| Hexavalent chromium | 0 |
| TYZOR CLA | 0–1 |

TABLE V-continued

| Treatment | Adhesion Loss |
|---|---|
| TYZOR 101 | 0–1 |
| TYZOR 131 | 0–1 |
| Water | 4–6 |

EXAMPLE 6

Steel panels are treated in accordance with the procedure described for Example 1 modified as described above. The results of a 240-hour salt spray test are summarized in the following Table VI.

TABLE VI

| | |
|---|---|
| Hexavalent chromium | 0–1 |
| TYZOR CLA | 0 |
| TYZOR 131 | 0–1 |
| TYZOR 101 | 3–4 |
| Water | 3–5 |

EXAMPLE 7

The procedure of Example 3 is repeated on galvanized steel except for the modifications described above. The results of an 80-hour salt spray test are summarized in the following Table VII.

TABLE VII

| | |
|---|---|
| Hexavalent chromium | 0–1 |
| TYZOR 131 | 0–1 |
| TYZOR 101 | 1–2 |
| TYZOR CLA | 2–3 |
| Water | 3 |

EXAMPLE 8

The procedure of Example 4 is repeated on steel except for the modifications described above. The results of a 390-hour salt spray test are summarized in the following Table VIII.

TABLE VIII

| Treatment | Adhesion Loss |
|---|---|
| Hexavalent chromium | 0–1 |
| TYZOR CLA | 0–1 |
| TYZOR 101 | 0–2 |
| TYZOR 131 | 0–2 |
| Water | 4–6 |

The are many variables in conversion coating technology which are utilized in commercial practice. The advantages of the method of the present invention and the improvements which are obtained generally appear to be independent of most variables. For example, desirable results are obtained whether the titanium chelates are applied by immersion or spray. Immersion generally is accomplished by swirling the metal in the bath, and spraying is accomplished at pressures of about 5 to 10 psi. The dry-off temperatures utilized after application of the titanium chelate to the phosphated metal surface generally range from about 35°–120° C. The titanium chelates did not appear to be temperature sensitive at these temperatures.

In some instances, phosphated metal surfaces are baked before painting in order to remove any water of hydration which may be present. In the method of the present invention, baking at 350° F. (177° C.) for five minutes does not affect performance of the titanium chelates even though water-soluble titanium chelates have boiling points below 350° F. Although not wishing to be bound by any theory, applicant believes that the water-soluble titanium chelates are converted to some type of insoluble complex on contact with the phosphate coating, and the insoluble complex is not affected by baking at the given temperatures.

When the titanium chelates are used at 1% by volume in water and followed by a deionized water rinse, it does not appear to matter whether the titanium chelate bath is prepared with tap water (conductivity of 300 micromhos) or deionized water (40 micromohs or less). However, when the titanium chelates are used at 0.25 pt. by volume per 100 gals., it is preferred to use deionized water for best results.

As can be seen from the above examples, a water rinse after treatment with the titanium chelates at low concentration is not essential. However, in a preferred embodiment, the titanium chelate treated phosphated metal surfaces are rinsed with water prior to painting.

The following examples illustrate the method of the invention when an oil top coat is applied to a metal article treated with a titanium chelate with and without a coating of paint.

EXAMPLE 9

(no paint)

The procedure of Example 1 is repeated except that the panels are not painted but given the following oil treatment. The chelate treated panels are immersed in the emulsion of Example E which is maintained at 15–20 percent by volume for approximately 60 seconds. The oil temperature is 80°–90° C. After removal from the oil, the panels are allowed to air dry until all of the emulsion has broken and no emulsion appearance remains on the panel.

EXAMPLE 10

(over paint)

The procedure of Example 1 is repeated and the painted panels, after curing, are immersed in the emulsion of Example E which is maintained at 15–20 percent by volume for approximately 60 seconds. The oil temperature is 80°–90° C. After removal from the oil, the panels are allowed to air dry until all of the emulsion has broken and no emulsion appearance remains on the panel.

The process of the present invention utilizing the specified water-soluble titanium chelates provides a useful substitute for chromium rinses. In contrast to the chrome rinses which are toxic, the titanium chelates are non-toxic. The reported toxicology data (DuPont) are summarized in the following Table IX. The average lethal dosev (ALD) is reported in milligrams of chemical per kilogram of body weight. Sodium chloride is included for comparison

TABLE IX

| Compound | ALD |
|---|---|
| Sodium chloride | 3750 |
| TYZOR CLA | 5,868 |
| TYZOR 101 | greater than 25,000 |
| TYZOR 131 | greater than 25,000 |

We claim:

1. A method of treating phosphated metal surfaces to improve the adhesion of siccative organic coatings thereto which comprises treating a phosphated metal surface with an aqueous solution of a water-soluble organic titanium chelate which forms a water-insoluble deposit on the phosphated metal surface.

2. The method of claim 1 wherein the phosphated metal surface is obtained by phosphating a metal surface with an aqueous acidic zinc, lead, iron, cadmium, or calcium-zinc phosphating solution.

3. The method of claim 1 wherein the aqueous solution of the water-soluble organic titanium chelate contains from about 0.005 to about 5% by volume of the chelate.

4. The method of claim 1 wherein the phosphated metal surface is treated with the aqueous solution of the water-soluble organic titanium chelate at about ambient temperature.

5. A method of treating phosphated metal surfaces to provide a durable rust-inhibiting coating comprising the steps of (a) treating a phosphated metal surface with an aqueous solution of a water-soluble organic titanium chelate which forms a water-insoluble titanium deposit on the phosphated metal surface, and (b) depositing on the titanium chelate treated phosphated metal surface, (i) a siccative organic coating, or (ii) a corrosion-inhibiting film of oil, or (iii) a siccative organic coating followed by a corrosion-inhibiting film of oil.

6. The method of claim 5 wherein the phosphated metal surface is a ferrous metal, zinc, aluminum, or alloy thereof phosphated with an aqueous acidic zinc, iron, or calcium-zinc phosphating solution.

7. The method of claim 5 wherein the aqueous solution of the water-soluble organic titanium chelate in step (a) contains from about 0.005 to about 5% by volume of titanium chelate.

8. The method of claim 5 wherein the treated surface obtained in step (a) is rinsed with water before step (b)(i).

9. The method of claim 5 wherein the phosphated metal surface is treated in step (a) with an aqueous solution of the water-soluble organic titanium chelate by immersion of the metal surface in the aqueous solution at about ambient temperature.

10. A method of treating phosphated metal articles to provide a corrosion-inhibiting coating which comprises the steps of (a) treating a phosphated metal article with an aqueous solution of a water-soluble organic titanium chelate which forms a water-insoluble titanium deposit on the phosphated metal article, and (b) applying a corrosion inhibiting film of oil as a seal coat.

11. The method of claim 10 wherein the oil applied in step (b) is a mineral oil which contains a metal-containing organic phosphate complex prepared by the process which comprises the reaction (a) a polyvalent metal salt of the acid phosphate esters derived from the reaction of phosphorus pentoxide with a mixture of a saturated aliphatic or cycloaliphatic monohydric alcohol containing from about 3 to about 18 carbon atoms, and from 0.25 to 4 equivalents of a polyhydric alcohol having from 2 to 4 hydroxyl groups and containing from about 2 to about 41 carbon atoms with (b) at least about 0.1 equivalent of an organic epoxide.

12. The method of claim 10 wherein the aqueous solution of (i) contains from about 0.005 to about 5% by volume of the water-soluble organic titanium chelate.

13. A method of treating phosphated metal articles to provide a corrosion-inhibiting coating comprising the steps of (a) treating a phosphated metal article with an aqueous solution of a water-soluble organic titanium chelate which forms a water-insoluble titanium deposit on the phosphated metal article, and (b) depositing a siccative organic coating on the titanium treated phosphated metal article.

14. The method of claim 13 wherein the article obtained in step (b) is coated with a corrosion-inhibited film of oil as a seal coat.

15. The method of claim 13 wherein the aqueous solution of (i) contains from about 0.005 to about 5% by volume of the water-soluble organic titanium chelate.

16. Metal surfaces treated in accordance with the method of claim 1.

17. Metal surfaces treated in accordance with the method of claim 6.

18. Metal articles treated in accordance with the method of claim 10.

19. Metal articles treated in accordance with the method of claim 13.

* * * * *

UNITED STATES PATENT OFFICE

CERTIFICATE OF CORRECTION

Patent No. 4,656,097 Dated April 7, 1987

Inventor(s) William J. Claffey and Alan J. Reid

It is certified that error appears in the above-identified patent and that said Letters Patent are hereby corrected as shown below:

On the Cover Page, Column 1

Correct [76] to read [75]

Between [75] and [21], insert --[73] Assignee - Man-Gill Chemical Company, Cleveland, Ohio--.

Signed and Sealed this

First Day of September, 1987

*Attest:*

*Attesting Officer*

DONALD J. QUIGG

*Commissioner of Patents and Trademarks*